United States Patent [19]

Erikson

[11] Patent Number: 4,671,163

[45] Date of Patent: Jun. 9, 1987

[54] METHOD OF LAUNCHING A MISSILE USING SECONDARY COMBUSTION

[75] Inventor: Edward E. Erikson, San Jose, Calif.

[73] Assignee: Westinghouse Electric Corp., Pittsburgh, Pa.

[21] Appl. No.: 755,119

[22] Filed: Jul. 15, 1985

[51] Int. Cl.[4] ..... F41F 3/04

[52] U.S. Cl. ..... 89/1.810; 89/1.818

[58] Field of Search ..... 89/1.810, 1.809, 1.818, 89/1.816, 1.8

[56] References Cited

U.S. PATENT DOCUMENTS

| | | | |
|---|---|---|---|
| 2,989,899 | 6/1961 | Siegel et al. | 89/1.810 |
| 3,087,386 | 4/1963 | Rung et al. | 89/1.810 |
| 3,088,377 | 5/1963 | Siegel et al. | 89/1.818 X |
| 3,137,203 | 6/1964 | Brown | 89/1.810 |
| 3,182,554 | 5/1965 | Barakauskas | 89/1.810 |
| 3,242,810 | 3/1966 | La Pointe | 89/1.810 |
| 3,295,411 | 1/1967 | Lehmann | 89/1.810 |
| 3,583,277 | 6/1971 | Crockett | 89/1.818 X |
| 4,185,538 | 1/1980 | Barakauskas | 89/1.810 |
| 4,436,016 | 3/1984 | Olmsted et al. | 89/1.809 |

*Primary Examiner*—David H. Brown

*Attorney, Agent, or Firm*—F. J. Baehr, Jr.

[57] ABSTRACT

In launching a missile from a launch tube, variable launch energy can be obtained by providing combustible products in the products of combustion from a gas generator and controlling the temperature and amount of oxygen present in the launch chamber to control the amount of secondary combustion in the launch chamber to provide a predetermined total launch energy and missile muzzle velocity.

5 Claims, 6 Drawing Figures

METHOD OF LAUNCHING A MISSILE USING SECONDARY COMBUSTION

GOVERNMENT CONTRACT

The Government has rights in this invention pursuant to Contract No. N0003081-C-3118 between Westinghouse Electric Corporation and the Department of Defense.

BACKGROUND OF THE INVENTION

This invention relates to missile launching and more particularly to a method of using secondary combustion to adjust the amount of energy available for a launch.

When launching a missile from a launch tube, a solid propellant charge is disposed in a pressure vessel, ignited and the products of combustion, gases, expand through a nozzle into a launch tube to eject a missile from the launch tube. Typically the gases are cooled utilizing water which is converted into steam which provides additional eject pressure and reduces the temperature in the launch tube to prevent secondary combustion.

SUMMARY OF THE INVENTION

A method of selectively increasing the energy output of a gas generator utilized to launch a missile from a launch tube, when practiced in accordance with this invention, comprises the steps of providing combustible products in the products of combustion produced by primary combustion within the gas generator; providing varying quantities of oxidant (i.e. oxygen) in the launch tube to burn the combustible products in the products of combustion produced by the gas generator; and controlling the temperature of the products of combustion produced by the gas generator to permit secondary combustion of the combustible products in the products of combustion with the provided oxidant, whereby an incremental increase in energy produced by the secondary combustion is proportional to the quantity of oxygen provided in the launch tube.

BRIEF DESCRIPTION OF THE DRAWINGS

The objects and advantages of this invention will become more apparent by reading the following detailed description in conjunction with the accompanying drawings, in which.

DESCRIPTION OF THE PREFERRED EMBODIMENT

Figure 1:
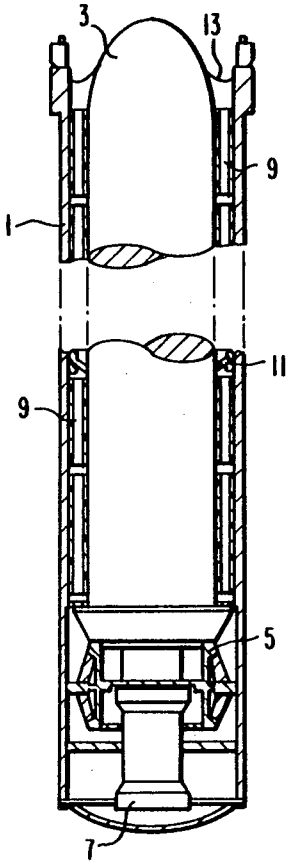
FIG. 1 is a partial sectional view of a missile in a launch tube.

Referring now to the drawings in detail and in particular to FIG. 1, there is shown a launch tube 1 having a missile 3 disposed therein. A missile supporting system 5 and gas generator 7 are shown adjacent one end of the launch tube 1. Shock isolation and support pads 9 are shown between the launch tube 1 and the missile 3 along with a seal 11 which seals the annular area between the launch tube 1 and missile 3. The other end of the launch tube is shown sealed by a membrane 13.

The primary source of energy utilized to launch the missile 3 is the gas generator 7 which consists of a solid propellant charge enclosed in a pressure vessel with an igniter and gas expansion nozzle (not shown). The solid propellant charge is configured in such a way to deliver a characteristic mass flow rate of products of combustion, generally gases, to the missile eject chamber, which provides the propellant force or pressure beneath the missile 3 for ejection. Missile launches used by the Navy are required to be conducted from different underwater depths consistent with the Navy's operational desires. With the present operational eject systems, energy is introduced into the launch tube at a fixed rate regardless of the water depth selected for launch and at low temperature. The low temperature during launch is required for some missiles and is accomplished by mixing water with high temperature gases from a solid propellant gas generator. The low temperature in combination with the entrained water droplets and steam within the eject gas mixture precludes secondary combustion of the gas products with the air initially in the eject chamber from occurring. Also, the use of nitrogen rather than air, which contains oxygen, would preclude secondary combustion due to the inert nature of nitrogen.

When using a solid propellant without water cooling the products of combustion have higher eject chamber temperatures. These higher temperatures combine with the available oxidants in the pressurized air to increase the probability of secondary combustion.

The products of combustion of solid propellant material normally contain materials which will burn or undergo combustion to varying degrees depending on the temperature, relative constant concentrations of fuel to oxidants, diluents, launch configuration and mixing of the materials. Typical products of combustion for two propellant types are shown in Table I noted below:

TABLE 1

GAS GENERATOR PROPELLANT PROPERTIES

| Parameter | Propellant A | | Propellant B | |
|---|---|---|---|---|
| Composition (% By Weight) | Graphite | 0.300 | — | |
| | $K_2SO_4$ | 2.030 | Binder | 13.000 |
| | 2-NDPA | 1.000 | — | |
| | NG | 29.760 | — | |
| | NC126 | 58.280 | AP | 85.000 |
| | TA | 7.680 | $Fe_2O_3$ | 1.000 |
| | Trimal | 0.950 | Al | 1.000 |
| Products of Combustion $P_o$ = 2500 psia (mole %) | | | | |
| *CO | 27.95 | | 8.41 | |
| $CO_2$ | 24.34 | | 15.68 | |
| HCl | — | | 18.37 | |
| *$H_2$ | 22.12 | | 10.96 | |
| $H_2O$ | 13.05 | | 36.11 | |
| $N_2$ | 11.75 | | 9.66 | |
| $FECl_2$ | — | | 0.33 | |
| $Al_2O_3$ | — | | 0.49 | |
| $K_2CO_3$ | 0.30 | | — | |
| *$CH_4$ and Others | 0.49 | | — | |

*Combustible

As can be seen, the products of combustion for both propellants, which are typcial of all available propellants, contain combustible materials, namely hydrogen $H_2$, carbon monoxide CO and methane $CH_4$. These combustible materials under the proper conditions combine with oxygen and liberate energy. The theoretical quantities of energy liberated when these materials burn in air are shown in Table 2.

TABLE 2

| Combustion Reaction | Energy Liberated BTU/lb |
|---|---|
| $H_2 + \frac{1}{2}O_2 \rightarrow H_2O$ | 51593 |
| $CH_4 + 2O_2 \rightarrow CO_2 + 2H_2O$ | 21518 |
| $CO + \frac{1}{2}O_2 \rightarrow CO_2$ | 4346 |

The energy delivered to the eject chamber is generaly lost by three phenomenon: heat transferred to the hardware components, heat transfer to the air within the eject chamber, and work (PdV) done on the missile during the launch.

The remainder or net energy after losses establishes the eject chamber pressure and temperature and the forces acting on the missile base to affect ejection.

Figure 2:
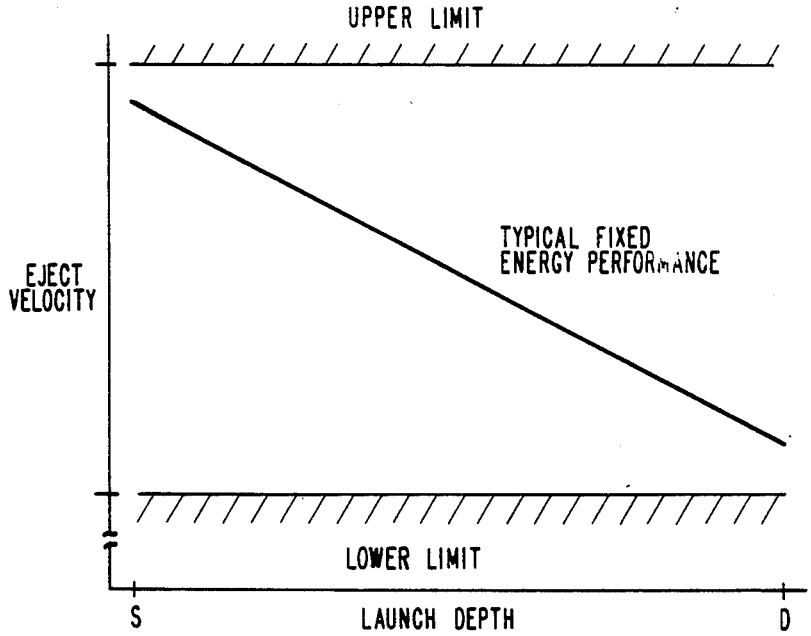
FIG. 2 is a curve showing eject velocity versus launch depth of the prior art gas generators.
Figure 3:
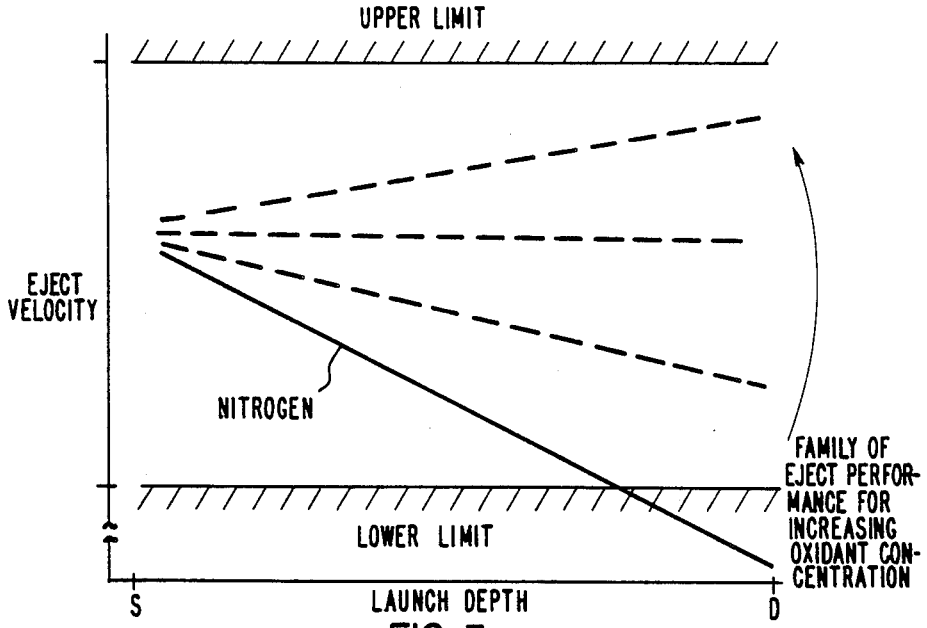
FIG. 3 is a curve showing eject velocity versus launch depth of ejectors utilizing secondary combustion.

The net energy available to do work can be made to vary as a function of the launch depth since the mass of air in the eject chamber varies due to prepressurization of the launcher to compensate for muzzle ambient sea pressure. The mass of air being greater at deep depths results in greater loss of energy and corresponding lower differential pressure acting on the missile. The lower differential pressure results in lower performance. The lower differential pressures are more predominantly noted in the presence of steam or absence of secondary combustion reactions. FIG. 2 depicts this phenomenon in terms of maximum missile velocity as a function of launch depth. As can be seen, a significant reduction in missile eject performance is realized due to the inevitable losses of energy as launch depth increases using conventional systems. This phenomenon is undesirable due to the resulting decrease in margin of available energy over required energy and difficulty in designing within the system requirements. Secondary combustion has been successfully utilized in the design of the Navy underwater vertical launchers. Its utilization has resulted in the simplistic design solution capable of providing acceptable performance within the typical tight performance constraints. The technique of utilizing secondary combustion comprises the design of a solid propellant gas generator without water injection to yield acceptable performance at shallow depths. Shallow depth launchers contain minimum oxidant due to essentially no pressurization, thus the effect of secondary combustion is minimal. The oxidant level is then increased with increasing depth which provides increasing amounts of energy to be liberated due to secondary combustion. For the bulk of the system to be designed, the amount of combustible products in the product of combustion from the gas generator is usually excessive. This characteristic allows the use of varying quantities of oxidant to provide varying amounts of energy to the launch. From the equations of combustion previously discussed, it can be seen that additional oxidant supplied to a mixture which is rich in combustible products will result in greater amounts of secondary combustion, hence, greater amounts of liberated energy and increased performance. This energy liberated in addition to that introduced by the gas generator is sufficient to overcome normal energy losses previously discussed. The result is performance which does not degrade like that obtained without secondary combustion as keel depth increases. FIG. 3 illustrates this phenomenon in terms of launch velocity.

Figure 4:
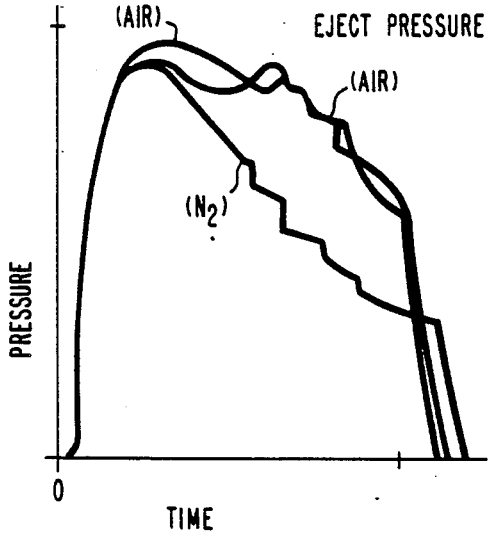
FIG. 4 is a curve of pressure versus time showing the added pressure caused by secondary combustion.
Figure 5:
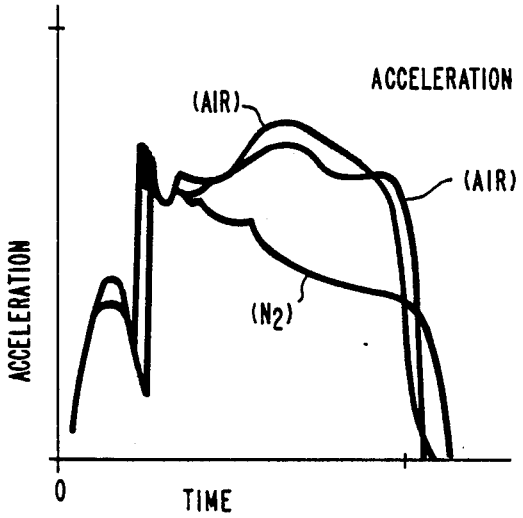
FIG. 5 is a curve of acceleration versus time showing the added acceleration due to secondary combustion.

The design can rely on the oxidant level contained in air alone to liberate additional energy or the oxidant level can be augmented by adding pure oxygen to liberate greater amounts of energy consistent with the products of combustion of the primary gas generator. The result is that the missile eject performance can be achieved within narrow constraints. The existence of the secondary combustion phenomenon has been verified during the Navy's capsule launching system development testing. FIGS. 4 and 5 show the comparison of air and nitrogen as the pressurizing medium during test launches with the same gas generator. As can be seen in FIGS. 4 and 5, the recorded pressure and corresponding acceleration are significantly greater for tests using air compared with those using nitrogen. This increased performance is directly attributable to the additional energy liberated by the secondary combustion of $H_2$, CO and $CH_4$ with the oxygen in the compressed air within the eject chamber. The base line preproduction missile launch system has been designed to achieve the required eject performance by utilizing secondary combustion of the products of combustion produced by the gas generator.

Figure 6:
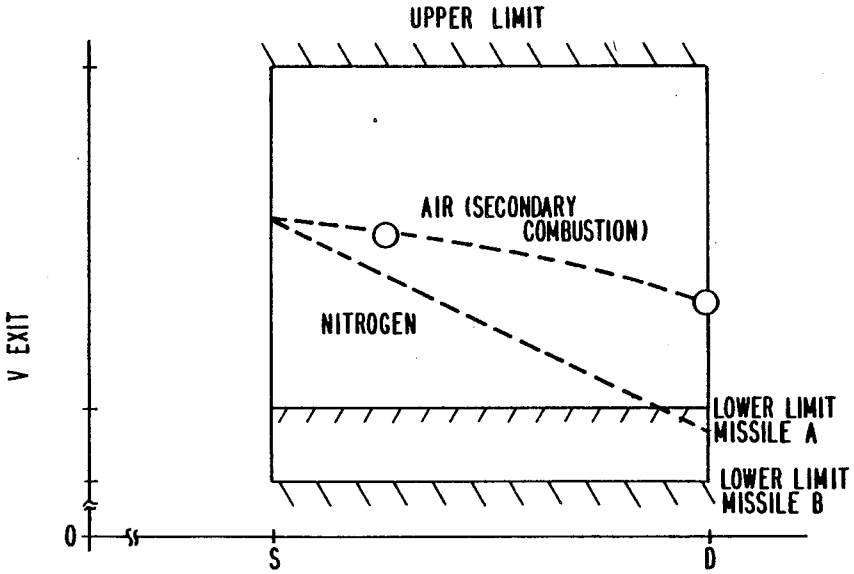
FIG. 6 is a curve showing exit velocity versus depth with and without secondary combustion.

FIG. 6 shows the resulting eject performance for the system using air and nitrogen. As shown therein, the use of secondary combustion has resulted in an eject performance capability meeting the imposed requirements. Another benefit in utilizing scrondary combustion is that the size of the gas generator is smaller taking up less volume aboard ship than its nitrogen counterpart which would require additional primary energy. Thus, secondary combustion can be harnessed and used in the design of missile launches or other pressure driven launch systems.

What is claimed is:

1. A method of selectively increasing the energy output of a gas generator utilized to launch a missile from a launch tube without igniting the missile until after it is launched from the tube comprising the steps of:

providing combustible products in the products of combustion produced by primary combustion within the gas generator;

providing varying quantities of oxidant in the launch tube to burn the combustible products in the products of combustion produced by the gas generator; and controlling the temperature of the products of combustion produced by the gas generator to permit secondary combustion of the combustible products in the products of combustion with the provided oxidant whereby the incremental increase in energy produced by secondary combustion is proportional to the quantity of oxygen in the launch tube.

2. A method of selectively increasing the energy output of a gas generator utilized to launch a missile from a launch tube as set forth in claim 1, wherein the step of providing combustible products in the products of combustion produced by primary combustion within the gas generator includes providing hydrogen, carbon monoxide and methane along with the products of combustion.

3. A method of selectively increasing the energy of a gas generator utilized to launch a missile from a launch tube as set forth in claim 1 and further comprising the steps of:

placing the launch tube below the surface of a body of water; and increasing the quantity of oxidant in the launch tube as the depth below the surface at which the missile is to be launched increases.

4. A method of selectively increasing the energy of a gas generator utilized to launch a missile from a launch tube as set forth in claim 3 wherein the step of increasing the quantity of oxidant in the launch tube includes providing compressed air to the launch tube, the pressure increasing with the depth at which the missile is to be launched.

5. A method of selectively increasing the energy output of a gas generator utilized to launch a missile from a launch tube as set forth in claim 4, wherein the step of providing combustible products in the products of combustion produced by primary combustion within the gas generator includes providing hydrogen, carbon monoxide and methane along with the products of combustion.

* * * * *